US006108499A

United States Patent [19]

Cernusak

[11] Patent Number: 6,108,499

[45] Date of Patent: Aug. 22, 2000

[54] DETERMINATION OF PHOTOCONDUCTOR WEAR

[75] Inventor: Nancy Cernusak, Eagle, Id.

[73] Assignee: Hewlett–Packard Company, Ft. Collins, Colo.

[21] Appl. No.: 09/396,133

[22] Filed: Sep. 14, 1999

[51] Int. Cl.[7] ..... G03G 15/00

[52] U.S. Cl. ..... 399/26; 399/389

[58] Field of Search ..... 399/24, 26, 43, 399/31, 35, 389

[56] References Cited

U.S. PATENT DOCUMENTS

| | | | |
|---|---|---|---|
| 4,860,052 | 8/1989 | Ito et al. . | |
| 5,021,828 | 6/1991 | Yamaguchi et al. . | |
| 5,564,845 | 10/1996 | Yamaguchi et al. | 400/582 |
| 5,596,391 | 1/1997 | Matsushita et al. | 399/45 |
| 5,661,550 | 8/1997 | Ko | 399/45 |
| 5,778,279 | 7/1998 | Kawai et al. | 399/42 |
| 5,822,646 | 10/1998 | Kinoshita et al. | 399/24 |
| 5,850,583 | 12/1998 | Song et al. | 399/24 |
| 5,887,222 | 3/1999 | Sako | 399/51 |

FOREIGN PATENT DOCUMENTS

| | | |
|---|---|---|
| 8-129325 | 5/1996 | Japan . |
| 9-016037 | 1/1997 | Japan . |
| 9-244486 | 9/1997 | Japan . |

*Primary Examiner*—Robert Beatty
*Attorney, Agent, or Firm*—Gregg W. Wisdom

[57] ABSTRACT

Printing on a large number of units of relatively narrow media accelerates wear on a photoconductor in an electrophotographic imaging device, such as an electrophotographic printer. The accelerated wear results from movement of a cleaning blade over a surface of the photoconductor on regions of the photoconductor outside a width of the media where toner is not available as a lubricant. The accelerated wear also results from exposure of the surface of the photoconductor on regions of the photoconductor outside the width of the media to the electric fields supplied by a transfer roller. The accelerated wear can cause excessive background development on the photoconductor. Background development toner not transferred to the media is collected in the waste hopper. Excessive background development can lead to leakage of toner from the waste hopper into the electrophotographic printer. By tracking the width of the media used, the electrophotographic printer can warn the user when photoconductor wear out may result in toner leakage from the waste hopper.

20 Claims, 7 Drawing Sheets

DETERMINATION OF PHOTOCONDUCTOR WEAR

FIELD OF THE INVENTION

This invention relates to electrophotographic imaging. More particularly, this invention relates to the detection of wear in components of electrophotographic imaging devices.

BACKGROUND OF THE INVENTION

Electrophotographic imaging devices, such as electrophotographic printers and copiers, use replaceable assemblies such as cartridges. These cartridges include components that require periodic replacement resulting from wear and materials consumed during the imaging operation. Components experiencing wear include photoconductors and charge rollers used in the electrophotographic imaging device. Components that are consumed include toner. Alternatively, electrophotographic imaging devices, such as copiers, may not use cartridges to contain the components that require periodic replacement. For these types of electrophotographic imaging devices, replacement of the components experiencing wear is generally more difficult.

Ideally, the components in the cartridge would not fail while sufficient toner remains for performing imaging operations. However, under certain conditions, components in the cartridge can fail before the toner in the cartridge is consumed. A need exists for a way to predict the possibility of failure of these components resulting from operation under these conditions.

SUMMARY OF THE INVENTION

Accordingly, in an electrophotographic imaging device, a method for determining wear on a photoconductor includes determining a plurality of values of a parameter related to a width of media used in the electrophotographic imaging device. The method also includes combining the plurality of values of the parameter to generate a first value. Additionally, the method includes comparing the first value to a first predetermined value. Furthermore the method includes generating an output if the first value equals or exceeds the first predetermined value.

An apparatus for determining wear on a photoconductor in an electrophotographic imaging device includes a first sensor located in the electrophotographic imaging device for detecting a presence of media having a width equal to or greater than a first value. The apparatus also includes a processing device coupled to the first sensor to count a first number of units of the media having the width less than the first value, with the processing device configured to generate an output based upon the first number reaching a first predetermined value.

An electrophotographic imaging device to form images on media with toner, includes a photoconductor and a photoconductor exposure system to generate a latent electrostatic image on the photoconductor. The electrophotographic imaging device also includes a developing device to develop the toner onto the latent electrostatic image, a transfer device to transfer the toner from the photoconductor onto the media, and a fixing device for fixing the toner to the media. The electrophotographic imaging device also includes a first sensor for detecting the media having a width equal to or greater than a first value. Furthermore, the electrophotographic imaging device includes a processing device coupled to the first sensor, with the processing device configured to count a first number of the media having a width less than the first value and configured to determine when the first number equals or exceeds a second value.

An electrophotographic imaging device to form images on media with toner using data received from a computer includes a photoconductor and a photoconductor exposure system to generate a latent electrostatic image on the photoconductor. The electrophotographic imaging device also includes a developing device to develop the toner onto the latent electrostatic image, a transfer device to transfer the toner from the photoconductor onto the media, and a fixing device for fixing the toner to the media. Furthermore, the electrophotographic imaging device includes a processing device configured to receive the data from the computer, with the data including information relating to a width of the media to which the data corresponds. The processing device includes a configuration to determine an area of the photoconductor substantially equal to a difference between a useable area on the photoconductor and a contact area between the media to which the data corresponds. The processing device also includes a configuration to add the area for a plurality of the media.

DESCRIPTION OF THE DRAWINGS

A more thorough understanding of embodiments of the invention may be had from the consideration of the following detailed description taken in conjunction with the accompanying drawings in which.

DETAILED DESCRIPTION OF THE DRAWINGS

The determination of wear on a photoconductor in electrophotographic imaging devices is not limited to the specific exemplary embodiments illustrated in this specification. Although the determination of wear on a photoconductor will be discussed in the context of the operation of a monochrome electrophotographic printer, one of ordinary skill in the art will recognize by understanding this specification that the disclosed principles for the determination of wear on a photoconductor have applicability in both color and monochrome electrophotographic imaging devices. Furthermore, although the embodiments of the systems for determining wear of a photoconductor will be discussed in the context of a monochrome electrophotographic printer, one of ordinary skill in the art will recognize by understanding this specification that other types of electrophotographic imaging devices, such as electrophotographic copiers (either color or monochrome) would benefit from having the capability to determine wear on a photoconductor. In addition, although the determination of wear of a photoconductor will be disclosed in the context of an electrophotographic printer that uses a photoconductor included in a replaceable cartridge, it should be recognized that the disclosed principles are applicable to electrophotographic imaging devices that use a photoconductor but do not use a replaceable cartridge.

Figure 1:
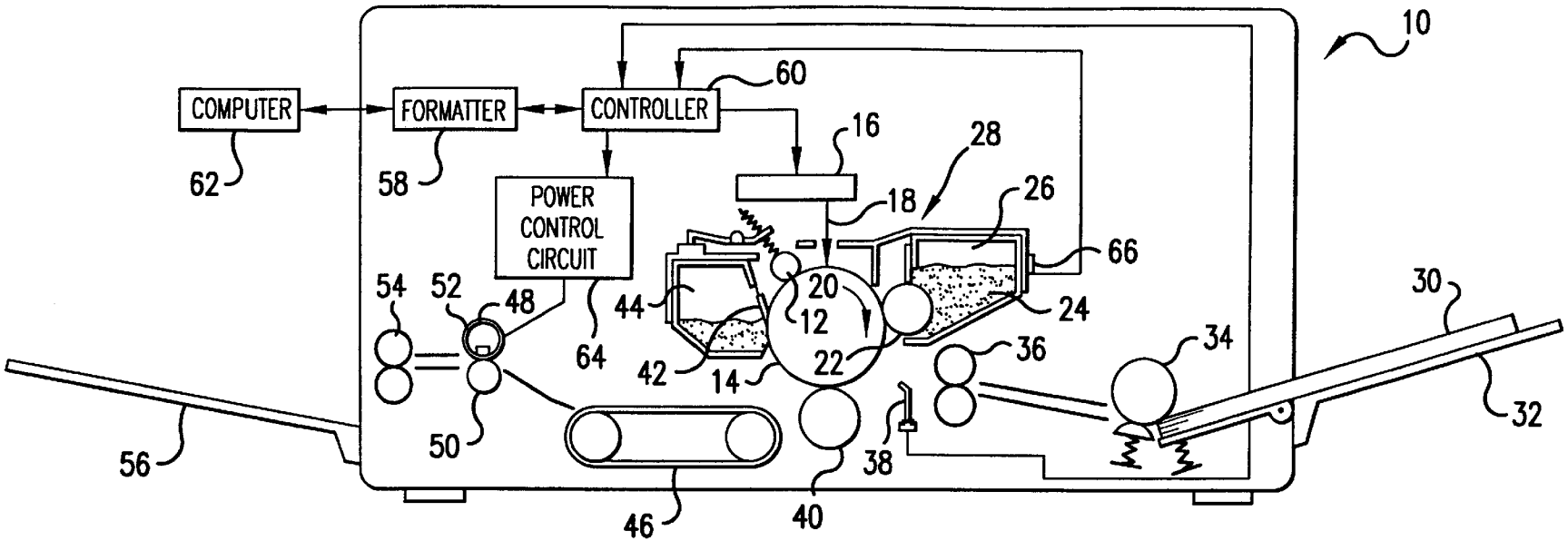
FIG. 1 shows a simplified view of an electrophotographic printer including an embodiment of a system for detecting wear on a photoconductor that uses a sensor to determine media width.

Referring to FIG. 1, shown is a simplified cross sectional view of an embodiment of an electrophotographic imaging device, electrophotographic printer 10. Charge roller 12 is used to charge the surface of a photoconductor, such as photoconductor drum 14, to a predetermined voltage. A laser diode (not shown) inside laser scanner 16 emits a laser beam 18 which is pulsed on and off as it is swept across the surface of photoconductor drum 14 to selectively discharge the surface of the photoconductor drum 14. Photoconductor drum 14 rotates in the clockwise direction as shown by the arrow 20. A developing device, such as developing roller 22, is used to develop the latent electrostatic image residing on the surface of photoconductor drum 14 after the surface voltage of the photoconductor drum 14 has been selectively discharged. Toner 24, which is stored in the toner reservoir 26 of electrophotographic print cartridge 28, moves from locations within the toner reservoir 26 to the developing roller 22. A magnet located within the developing roller 22 magnetically attracts toner 24 to the surface of the developing roller 22. As the developing roller 22 rotates in the counterclockwise direction, toner 24, located on the surface of the developing roller 22 opposite the areas on the surface of photoconductor drum 14 which are discharged, can be moved across the gap between the surface of the photoconductor drum 14 and the surface of the developing roller 22 to develop the latent electrostatic image.

Media, such as print media 30, is loaded from media tray 32 by pickup roller 34 into the paper path of the electrophotographic printer 10. A sensor, such as width sensor 38, is located near the path print media 30 follows through electrophotographic printer 10. In electrophotographic printer 10, width sensor 38 includes a sensor arm positioned in the path of print media 30. As print media 30 moves through electrophotographic printer 10, print media 30 rotates the sensor arm about a pivot point. An optical detector, included in width sensor 38, optically detects the movement of an end of the sensor arm past the optical sensor, thereby detecting the movement of print media 30 through electrophotographic printer 10. It should be recognized that other sensor types capable of detecting the presence of print media 30 having widths equal to or greater than that corresponding to the location of width sensor 38 could be used. Furthermore, it should be recognized that more than one sensor for detecting media width could be used for determining the wear on photoconductor drum 14. With respect to a longitudinal axis of photoconductor drum 14, width sensor 38 is positioned to detect a presence of print media 30 greater than or equal to a predetermined width. Print media 30 having a width less than the predetermined width is not detected by width sensor 38. Print media 30 having a width greater than or equal to the predetermined width is detected by width sensor 38.

Print media 30 moves through the drive rollers 36 so that the arrival of the leading edge of print media 30 below photoconductor drum 14 is synchronized with the rotation of the region on the surface of photoconductor drum 14 having a latent electrostatic image corresponding to the leading edge of print media 30. As the photoconductor drum 14 continues to rotate in the clockwise direction, the surface of the photoconductor drum 14, having toner adhered to it in the discharged areas, contacts the print media 30 which has been charged by a transfer device, such as transfer roller 40, so that it attracts the toner particles away from the surface of the photoconductor drum 16 and onto the surface of the print media 30. The transfer of toner particles from the surface of photoconductor drum 14 to the surface of the print media 30 is not fully efficient and therefore some toner particles remain on the surface of photoconductor drum 14. As photoconductor drum 14 continues to rotate, toner particles which remain adhered to its surface are removed by cleaning blade 42 and deposited in toner waste hopper 44.

As the print media 30 moves in the media path past photoconductor drum 14, conveyer 46 delivers the print media 30 to a fixing device, such as fuser 48. Print media 30 passes between pressure roller 50 and the sleeve 52 of fuser 48. Pressure roller 50 is coupled to a gear train (not shown in FIG. 1) in electrophotographic printer 10. Print media 30 passing between pressure roller 50 and fuser 48 is forced against sleeve 52 of fuser 48 by pressure roller 50. As pressure roller 50 rotates, sleeve 52 is rotated and print media 30 is pulled between sleeve 52 and pressure roller 50. Heat applied to print media 30 by fuser 48 fixes toner 24 to the surface of print media 30. Output rollers 54 push the print media 30 into the output tray 56 after it exits fuser 48.

The embodiment of the electrophotographic imaging device shown in FIG. 1, electrophotographic printer 10, includes a processing device, such as formatter 58 and controller 60. Alternatively, electrophotographic printer 10 could use other processing devices such as a microprocessor, or other digital state machines. Formatter 58 receives data, including print data (such as, a display list, vector graphics, or raster print data) from the print driver operating in conjunction with an application program in computer 62. Formatter 58 converts this relatively high level print data into a stream of binary print data. Formatter 58 sends the stream of binary print data to controller 60. In addition, formatter 58 and controller 60 exchange data necessary for controlling the electrophotographic printing process. Controller 60 supplies the stream of binary print data to laser scanner 16. The binary print data stream sent to the laser diode in laser scanner 16 pulses the laser diode to create the latent electrostatic image on photoconductor drum 14.

In addition to providing the binary print data stream to laser scanner 16, controller 60 controls a high voltage power supply (not shown in FIG. 1) to supply voltages and currents to components used in the electrophotographic processes, such as charge roller 12, developing roller 22, and transfer roller 40. Furthermore, controller 60 controls the drive motor (not shown in FIG. 1) that provides power to a gear train (not shown in FIG. 1) in electrophotographic printer 10 and controller 60 controls the various clutches and paper feed rollers necessary to move print media 30 through the media path of electrophotographic printer 10. A power control circuit 64 controls the application of power to fuser 48.

Electrophotographic print cartridge 28 includes an identification device, such as memory 66, that contains information permitting controller 60 to identify electrophotographic print cartridge 28. After installation of electrophotographic print cartridge 28 into electrophotographic printer 10, controller 60 reads the information contained in memory 66 to identify electrophotographic print cartridge 28. Because electrophotographic print cartridge 28 is designed for easy installation and removal in electrophotographic printer 10, memory 66 is preferably designed to couple to controller 60 through a 2 or 3 wire bus to minimize the complexity of the connecting hardware. Alternatively, formatter 58 could be coupled to memory 66 and configured to read the information contained in memory 66 to identify electrophotographic print cartridge 28. As will be discussed in further detail later in this specification, the use of an identification device associated with a photoconductor permits tracking of the wear on the photoconductor even under the circumstances in which different photoconductors are used.

Typically, the print media 30 used in electrophotographic printer 10 includes 8½" by 11" letter sized paper. However, electrophotographic printer 10 has the capability to make use of print media 30 having a range of widths. For example, print media 30 could include media having a narrow width, that is, a width less than that of letter size paper, such as cards (e.g. note cards, post cards, greeting cards, or the like) or envelopes. As used in this specification, the term "width" refers to a dimension of the media substantially perpendicular to the direction the media moves through the electrophotographic imaging device. When printing is done on narrow media, such as envelopes, the envelopes move through electrophotographic printer 10 so that the long dimension of the envelopes is substantially parallel to the path followed by print media 30 through electrophotographic printer 10. With this orientation of the envelopes, only a section of the width of photoconductor drum contacts the envelopes as they move through electrophotographic printer 10. As will be explained below, if a large number of units of print media 30 having relatively narrow widths are used in electrophotographic printer 10, photoconductor drum 14 can experience wear that can result in damage to electrophotographic printer 10.

At least two types of wear mechanisms of photoconductor drum 14 result from using a large number of units of print media 30 having relatively narrow widths. One wear mechanism results from cyclic charging of photoconductor drum 14. Another wear mechanism results from mechanical contact of cleaning blade 42 on the surface of photoconductor drum 14. Both of these mechanisms result in permanent changes to photoconductor drum 14 that can result in damage to electrophotographic printer 10.

In the electrophotographic printer 10, toner 24 is negatively charged, the surface of photoconductor drum 14 is negatively charged by charge roller 12 (and discharged toward ground by laser beam 18 to form the latent electrostatic image), and transfer roller 40 positively charges a surface of print media 30 opposite that to which toner will be transferred. The electric field generated between the surface of photoconductor drum 14 and the positively charged print media 30 pulls toner 24 from the surface of photoconductor drum 14 onto the surface of print media 30. It should be recognized that, although the wear of photoconductor drum 14 will be discussed in the context of electrophotographic printer 10 using a particular set of charge polarities and bias voltage polarities, the wear mechanisms also occur in electrophotographic imaging devices using other sets of charge polarities and bias voltage polarities.

Consider, for example, printing, where print media 30 includes narrow media, such as a standard size envelope. A short time before the leading edge of the envelope passes between transfer roller 40 and photoconductor drum 14, a positive DC voltage is applied by the high voltage power supply included in electrophotographic printer 10 to transfer roller 40. This positive DC voltage is used by transfer roller 40 for contact charging of a surface of the envelope, opposite the surface that contacts photoconductor drum 14 during transfer, to a polarity opposite that of the charge on toner 24 on the surface of photoconductor drum 14. The positive DC voltage applied to transfer roller 40 is typically in the range of 2 KV to 4 KV. In addition to positively charging the surface of the envelope, a portion of the surface of photoconductor drum 14 that is exposed to transfer roller 40 (i.e. that portion of photoconductor drum 14 that is not shielded by the envelope from exposure to transfer roller 40) receives positive charge from transfer roller 40. As photoconductor drum 14 rotates after passing transfer roller 40, it is negatively charged by charge roller 12. Therefore, the portions of the surface of photoconductor drum 14 that are not shielded by the envelopes undergo cyclic charging from negative polarity to positive polarity.

When printing is performed using a large number of envelopes, the exposed portions of the surface of photoconductor drum 14 undergo repeated cycling between positive and negative voltages. The repeated exposure of photoconductor drum 14 to relatively high levels of positive charge causes electrical fatigue of photoconductor drum 14. This electrical fatigue manifests itself as degradation in the ability of photoconductor 14 to hold the negative charge supplied by charge roller 12 during the electrophotographic imaging process.

Another wear mechanism for photoconductor drum 14 results from printing on large numbers of envelopes (or other relatively narrow sized media or media have relatively low levels of coverage). Cleaning blade 42 is mechanically loaded against the surface of photoconductor drum 14. Its function is to remove toner that remains on the surface of photoconductor drum 14 after the transfer process. Although cleaning blade 42 is typically constructed from a flexible plastic material, such as a urethane, contact with surface of photoconductor drum 14 results in wear of photoconductor drum 14. Although these wear mechanisms are discussed in the context of using narrow media, such as an envelope, it should be recognized the same wear mechanisms are experienced with other types of narrow media, such as cards.

During the development of the latent electrostatic image, toner 24 is projected from a sleeve of developing roller 22 into the gap between developing roller 22 and photoconductor drum 14. The charge distribution on the surface of photoconductor drum 14 and the AC bias superimposed upon the DC bias supplied to developing roller 22 forms the electric field that projects toner 24 into the gap between developing roller 22 and photoconductor drum 14. Some of the projected toner 24 adheres to the surface of photoconductor drum 14 in the areas discharged by laser beam 18 and on areas adjacent to those areas receiving the highest levels of exposure by laser beam 18. After areas on the surface of photoconductor drum 14 onto which toner 24 has been developed pass by transfer roller 40, some amount of toner 24 remains. For printing on a 8½ by 11 inch sheet of paper at an average level of coverage (in the range of 5% of the area of one side), the toner 24 remaining on the surface of photoconductor drum 14 provides lubrication between cleaning blade 42 and the surface of photoconductor drum 14. This lubrication reduces the wear caused by the contact of cleaning blade 42 with the surface photoconductor drum 14.

Printing on narrow media, such as cards or envelopes, typically involves printing a mailing address and a return address, a relatively low coverage print job. Because of the typical low coverage on cards or envelopes, those areas of photoconductor drum 14 that correspond to the width of the card or envelope will, on average, not have a substantial amount of toner 24 remaining on the surface of photoconductor drum 14 after transfer for lubricating cleaning blade 42. In addition, because there are relatively large areas on the surface of photoconductor drum 14 outside of the width of the cards or envelopes that are not exposed by laser beam 18, very little of toner 24 is available in these areas on the surface of photoconductor drum 14 to provide lubrication for cleaning blade 42. The lack of substantial amounts of toner remaining on the surface of photoconductor drum 14 after transfer, both inside the area corresponding to the width of the card or envelope and outside the area corresponding to the width of the card or envelope, contributes to the wear experienced by photoconductor drum 14 from cleaning blade 42. The effect of the wear of the outer layer of photoconductor drum 14 is to degrade the ability of photoconductor drum 14 to hold the negative charge supplied by charge roller 12 during the electrophotographic imaging process.

Background development of toner 24 is the development of toner 24 onto regions of photoconductor drum 14 that have not been exposed by laser beam 18. Printing a sufficiently large number of units of low coverage or narrow width media causes a degradation in the ability of photoconductor to resist background development of toner. After locations on the surface of photoconductor drum 14 are charged by charge roller 12 they rotate in the clockwise direction (as shown by arrow 20 in FIG. 1) toward developing roller 22. During the time period after charging but before reaching developing roller 22, those locations on photoconductor drum 14 affected by electrical fatigue, or mechanical wear, or both can experience a substantial loss of the negative charge supplied by charge roller 12. On those areas on the surface of photoconductor drum 14 not exposed to laser beam 18, the negative charge deposited on the surface of photoconductor drum 14 repels the negatively charged toner 24 projected from developing roller 22 into the gap between photoconductor drum 14 and developing roller 22. The charge on toner 24 follows a distribution with some particles more negatively charged than others. Because the electrical or mechanical wear on the surface of photoconductor drum 14 results in a reduction in the magnitude of the negative voltage as it passes developing roller 22, the less negatively charged particles of toner 24 will tend to be attracted to the surface of photoconductor drum 14. Had these areas of photoconductor drum 14 not experienced electrical or mechanical wear they should repel toner 24 because of the negative charge supplied by charge roller 12 to the surface of photoconductor drum 14.

The toner 24 developed onto the surface of photoconductor drum 14 resulting from the electrical and mechanical wear it experiences is removed from the surface of photoconductor drum 14 by cleaning blade 42 and deposited in waste hopper 44. Because the wear that results in the background development on photoconductor drum 14 comes about, to a large degree, from the printing of low coverage print jobs, it is quite possible at the time that the background development begins to appear that substantial amounts of toner 24 remain in toner reservoir 26. However, it should be recognized that it is also possible that the wear resulting in the background development does not occur to a sufficient degree until only relatively small amounts of toner 24 remain in reservoir 26.

Waste hopper 44 is small relative to toner reservoir 26 because under normal operating conditions, only a small fraction of the toner supplied from toner reservoir 26 is deposited in waste hopper 44. Consequently, when the wear on photoconductor drum 14 reaches the point at which substantial quantities (as compared to the quantities during normal operation) of toner 24 are deposited into waste hopper 44, the available storage volume in waste hopper 44 is quickly filled.

Typically, in electrophotographic print cartridge 28, there are seals located between the opening of waste hopper 44 and photoconductor drum 14. The seals contact the surface of photoconductor drum 14 and are intended to prevent toner stored in waste hopper 44 from leaking out into electrophotographic printer 10. After waste hopper 44 is filled beyond its normal maximum toner carrying capacity, the likelihood of toner 24 leaking from waste hopper 44 is greatly increased. If toner 24 leaks from waste hopper 44, it will get distributed on the interior of electrophotographic printer 10, particularly along the path followed by print media 30. The leaking toner 24 can adhere to print media 30 that passes through electrophotographic printer 10 resulting in print defects.

Toner 24 leaking from waste hopper 44 tends to move downward and accumulate in an area near transfer roller 40. This toner 24 is attracted to the back side of successive units of print media 30 passing over transfer roller 40. When these units of print media 30 pass through fuser 48, the toner 24 attracted to the back side of print media 30 is fixed to print media 30, resulting in a print defect. Additionally, toner 24 leaking from waste hopper 44 migrates throughout electrophotographic printer 10 potentially contaminating assemblies in electrophotographic printer 10. Fuser 48 is particularly susceptible to contamination from toner 24 that leaks from waste hopper 44. Toner 24 that adheres to fuser 48 will, over time, migrate to pressure roller 50. When a sufficient amount of toner 24 has accumulated on pressure roller 50 it will adhere to the next available unit of print media 30 passing through electrophotographic printer 10, creating a prominent print defect on print media 30. Although toner 24 can be removed from fuser 48 by using a cleaning page, some users may unnecessarily replace fuser 48 once print defects associated with fuser 48 appear.

Repairing the damage that results to electrophotographic printer 10 from the toner 24 leaking from waste hopper 44 can be costly and time consuming. Repair involves removal of the leaking electrophotographic print cartridge 28, partial disassembly and cleaning of electrophotographic printer 10. A need exists for a method and apparatus that can warn users of the potential for occurrence of this failure mode.

Figure 2:
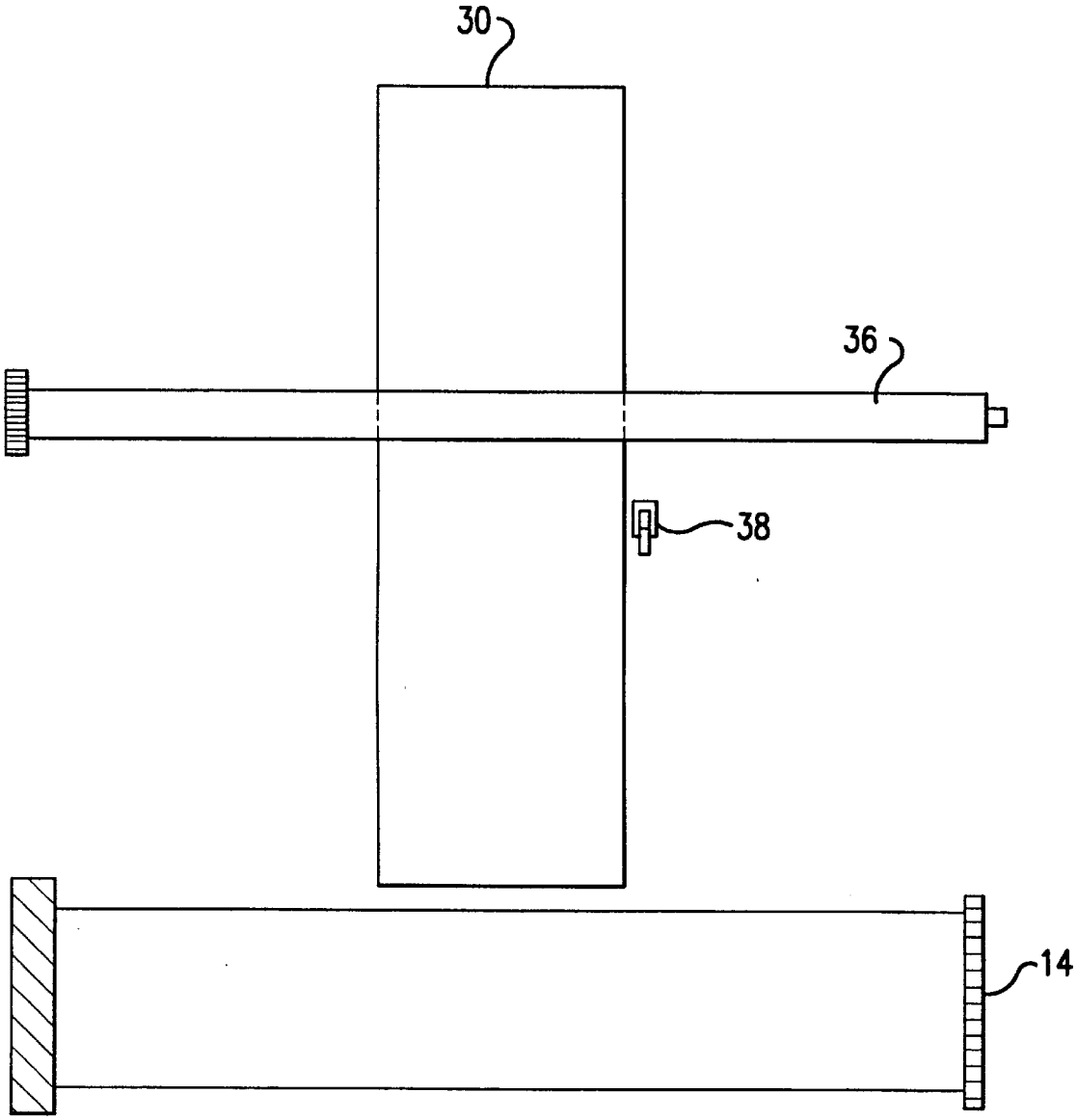
FIG. 2 shows a simplified view of the positioning of a sensor for detecting media width in the media path of an electrophotographic printer.

Shown in FIG. 2 is a drawing showing a simplified view of a portion of the path print media 30 moves through electrophotographic printer 10. FIG. 2 shows the relative positions of width sensor 38 with respect to the longitudinal axis of photoconductor drum 14, drive rollers 36, and a narrow unit of print media 30, such as a standard size envelope. In FIG. 2, width sensor 38 is positioned, with respect to the longitudinal axis of photoconductor drum 14, so that if print media 30 includes narrow media, such as standard size envelopes, width sensor 38 is located outside, and adjacent to, the path print media 30 follows during movement through electrophotographic printer 10. Therefore, for the position of width sensor 38 shown in FIG. 2, standard size envelopes will not cause width sensor 38 to signal the detection of print media 30 to controller 60.

Width sensor 38, as positioned in FIG. 2, detects whether the unit of print media 30 passing through electrophotographic printer 10 has a width greater than or less than or equal to that of a standard envelope. A counter created in the firmware operating in controller 60 maintains a count of the number of units of print media 30 passing through electrophotographic printer 10 having a width less than or equal to the width of a standard size envelope that have been printed upon using photoconductor drum 14. In this way, the width of print media 30 passing through electrophotographic printer 10 is determined to be in one of two exemplary width ranges, less than or equal to the width of standard size envelopes (or other narrow media used as the basis for the placement of width sensor 38) or greater than the width of standard size envelopes. When this count reaches a predetermined value, controller 60 signals formatter 58 that this predetermined value has been reached. If a processing device such as a digital state machine were used instead of controller 60, the counter could be implemented in hardware instead of the firmware operating controller 60.

The count maintained by controller 60 provides a measurement of the wear on photoconductor drum 14. Therefore, this count is specifically associated with photoconductor drum 14. Using information stored in memory 66, controller 60 is able to uniquely associate the count with the specific photoconductor drum 14 included in electrophotographic print cartridge 28. If electrophotographic print cartridge 28, including photoconductor drum 14, is removed and a replacement electrophotographic print cartridge (including a replacement photoconductor drum) is inserted, controller 60 saves the count value for photoconductor drum 14 and with it the information used to uniquely identify electrophotographic print cartridge 28. Then, controller 60 begins counting the number of units of print media 30, having a width less than or equal to the width of a standard size envelope, on which printing is performed using the replacement photoconductor drum. If electrophotographic print cartridge 28, including photoconductor drum 14, is re-inserted into electrophotographic printer 10, controller 60 would save the count value for the replacement photoconductor drum (and with it the information that uniquely identifies the replacement photoconductor drum) and set the count to the value after it was last incremented before removal of electrophotographic print cartridge 28 and photoconductor drum 14. It should be recognized that if the photoconductor used in the imaging device was not included in an electrophotographic print cartridge, the identification device could be included in the photoconductor.

Formatter 58 could inform the user of the potential for leaking of toner 24 in a variety of ways. Formatter 58 could signal computer 62 that the allowable narrow media count has been exceeded. In turn, computer 62 could display a message that the allowable narrow media count had been exceeded and recommend replacement of electrophotographic print cartridge 28. Alternatively, formatter 58 could cause display of a message on the front panel of electrophotographic printer 10 indicating that the allowable narrow media count had been exceeded. Another alternative is for controller 60 to disable use of electrophotographic printer 10 and display a message on computer 62 or on the front panel of electrophotographic printer 10 informing the user that electrophotographic print cartridge 28 requires replacement. In yet another alternative, if electrophotographic printer 10 was configured to receive print jobs over a network, formatter 58 could signal the network server when the allowable narrow media count was exceeded. The network administrator could have the option of permitting continued printing or disable further printing until replacement of electrophotographic print cartridge 28. For any of the previously mentioned ways in which the user could be informed, the user could be given the option to disable (with an appropriate caution regarding possible damage) generation of the warning message by electrophotographic printer 10. The specific message used to inform the user that the allowable narrow media count had been exceeded may vary depending upon the amount of toner 24 that remains in toner reservoir 26. If the electrophotographic print cartridge for which the narrow media count has been exceeded has been used almost exclusively for printing on narrow media, then substantial amounts of toner 24 would remain in toner reservoir 26. Accordingly, the user would have an expectation that substantial printing life should remain in electrophotographic print cartridge 28. With electrophotographic printer 10 including the capability to measure the amount of toner remaining in toner reservoir 26, the message displayed to the user when the narrow media count is exceeded could provide additional explanation regarding photoconductor wear if the narrow media count is exceeded while relatively large amounts of toner remain in toner reservoir 26.

One way in which the allowable narrow media count can be determined is empirically. An empirical determination of the allowable narrow media count would involve life testing of a sufficiently large sample of cartridges having the same design of electrophotographic print cartridge 28. Print media 30 would include narrow width media, such as envelopes or cards. Printing would be performed using the test group of cartridges until leakage failures were detected. By testing a sufficiently large sample size, a reliable estimate of the range of variability of the number of units of narrow width media required before failure could be determined. The lower limit of the range, with sufficient margin, could be used as the allowable narrow media count for the population.

Although width sensor 38, as shown in FIG. 2, is positioned (with respect to the longitudinal axis of photoconductor drum 14) so that print media 30 having a width greater than that of a standard size envelope will be detected by it, the position of width sensor 38 would be different depending upon the predominant type of narrow media used. For example, if it was determined that a large majority of narrow media printing was on note cards, width sensor 38 would be positioned just outside the width corresponding to the note card. Accordingly, with different positioning of width sensor 38, the predetermined value of the count at which controller 60 signals formatter 58 will be different. For example, using a large number of note cards will cause greater wear over the same number of units of print media 30 than using standard size envelopes. Alternatively, if the width sensor 38 were located at a position corresponding to that of standard size envelopes and it was expected that there would also be substantial numbers of more narrow media used (such as note cards) the predetermined value would be appropriately adjusted to account for the increased wear to warn the user before the leaking of toner 24 from waste hopper 44.

Using a single width sensor 38 is a basic implementation of an apparatus to inform users of a possible failure mode of electrophotographic print cartridge 28. More sophisticated implementations are possible. The implementation shown in FIG. 2 uses a single width sensor 38 to determine whether print media 30 is of width greater or less than narrow media, such as an envelope. By using multiple sensors to determine width, a more accurate determination of the wear on photoconductor drum 14 over a wider range of media widths can be obtained.

Whether a given area on the surface of photoconductor drum 14 will begin to experience background development resulting from electrical or mechanical wear will depend upon the conditions to which that area of the surface of photoconductor drum 14 is exposed over the printing life of electrophotographic print cartridge 28. For example, if the printing that has been done primarily involves the usage of narrow media, such as standard size envelopes, the regions on the surface of photoconductor drum 14 located near the center of its longitudinal axis will experience substantially less wear than those regions on the surface of photoconductor drum 14 located outside the width of the standard size envelopes. Similarly, if a range of widths of print media 30 are used throughout the printing life of electrophotographic print cartridge 28, different regions of the surface of photoconductor drum 14 will experience wear to different degrees.

It is possible by printing with a combination of different numbers of print media 30, having a variety of widths ranging from the narrowest type of narrow media used to letter sized paper, to induce wear at different rates on different portions of the surface of photoconductor drum 14. As a result, it is possible, at a given time during the printing life of electrophotographic print cartridge 28, that different regions on the surface of photoconductor drum 14 will experience background development to different degrees depending upon the widths of print media 30 that have been used for printing. Therefore, waste toner hopper 44 will be filled with toner at different rates depending upon the mix of the widths of print media 30 upon which printing has been performed.

For example, if the units of print media 30 used in electrophotographic printer 10 included an equal mix of narrow media, such as standard size envelopes, and media having a width half way between standard size envelopes and letter size paper, it may result that only the portion of the surface of photoconductor drum 14 corresponding to two strips, each having a width substantially equal to the difference between the letter sized media and the media having a width halfway between standard size envelopes and letter size paper, will experience sufficient wear that substantial amounts of background development occur. These two strips would be located on the drum in the region corresponding to the distance between the outside edge of letter size paper and the outside edge of the media having a width halfway between standard size envelopes and letter size paper. If this is the case, then a larger number of rotations of photoconductor drum 14 would be required to fill waste toner hopper 44, than would be required if only standard envelope size media were used. Accordingly, waste toner hopper 44 would be filled at a lower rate using media of multiple widths than with the exclusive use of standard size envelopes. However, a single sensor located outside and near the outside edge of standard size envelopes would not differentiate between the use of media having a width halfway between standard size envelopes and letter size paper.

Determination of wear on a photoconductor using multiple sensors to detect the presence of different sizes of media would involve counting the number of units of each of the sizes of print media 30 used by the electrophotographic printer. The counts of each of these media sizes would be weighted and added to determine if a predetermined value (related to the potential filling of waste hopper 44) has been crossed. The specific weighting assigned to the counts of each of the media widths could be empirically derived.

Figure 3:
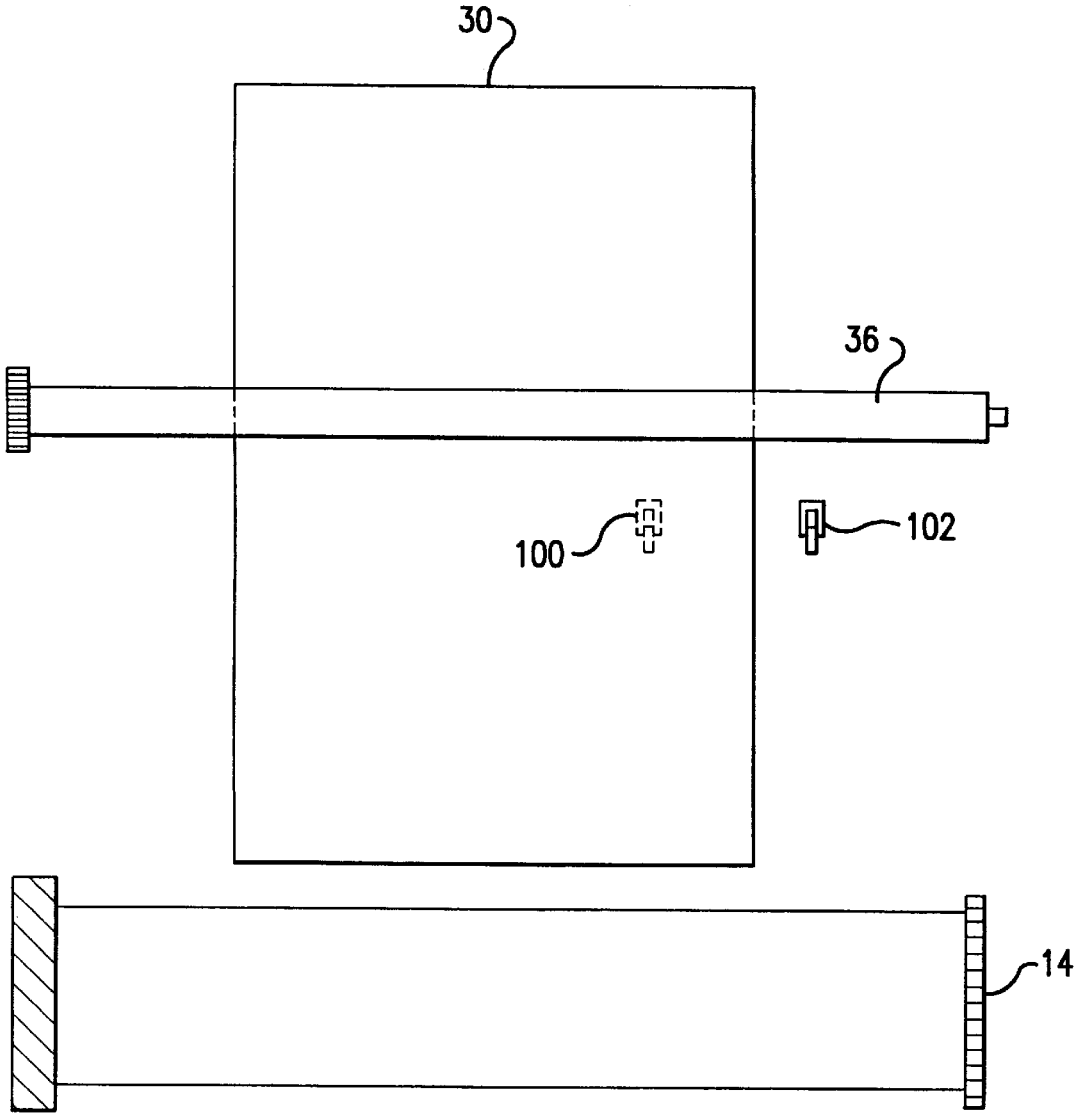
FIG. 3 shows a simplified view of the positioning of two sensors for determining media width in the media path of an electrophotographic printer.

Shown in FIG. 3 is a simplified view of a possible implementation of a system for predicting wear of photoconductor drum 14 using two sensors for determining the width of print media 30. FIG. 3 shows the position of the two sensors with respect to the longitudinal axis of photoconductor drum 14 and drive rollers 36 and the position of print media 30 having a width so that an outside edge lies between first width sensor 100 and second width sensor 102. With two sensors, the width of print media 30 can be determined to exist in one of three ranges, a width less than that corresponding to the position of first sensor 100, a width greater than or equal to that corresponding to the position of the first sensor and less than that of the second sensor, and a width greater than or equal to that corresponding to the position of the second sensor. First width sensor 100 and second width sensor 102 are positioned relative to each other so that controller 60 can distinguish between narrow media, such as standard size envelopes, letter size paper, and the most common type of print media 30 having a width in between the width of letter sized paper and standard sized envelopes. Both first width sensor 100 and second width sensor 102 provide signals to controller 60.

In this implementation, the firmware operating in controller 60 increments one of two counters in response to receiving the corresponding signal from first width sensor 100 or second width sensor 102. The first counter counts the number of units of media having a width such that it will not be detected by first width sensor 100 and second width sensor 102. The second counter counts the number of units of media having a width such that it will be detected by first width sensor 100, but not by second width sensor 102. The count values from the first counter and the second counter are weighted and added by controller 60 to generate a value to compare to a predetermined value.

The weighting of the count values depends upon the relative sizes of the surface areas of photoconductor drum 14 corresponding to first width sensor 100 and second width sensor 102 associated with the first counter and the second counter. For example, consider an implementation in which first width sensor 100 is positioned relative to the longitudinal axis of photoconductor drum 14 so that it lies outside, and adjacent to, the width of standard size envelopes and second width sensor 102 lies halfway between the outer edge of the width of letter size paper and the outer edge of the width of standard size envelopes. For this implementation, the pair of strips formed by the region between the outer edge of the width of the letter size paper and the second width sensor 102 have approximately the same area as the pair of strips formed by the region between the first width sensor 100 and the second width sensor 102.

In terms of the contribution to the wear of photoconductor drum 14, the two pairs of strips experience substantially the same amount of wear (when print media 30 is not sufficiently wide to cover these areas of photoconductor drum 14). Therefore, printing with a standard size envelope will cause wear on approximately twice the surface area of photoconductor drum 14 as will printing with media having a width such that its outer edge is located near second width sensor 102. In terms of the contribution to filling waste hopper 44 with toner, after sufficient wear occurs on photoconductor drum 14 so that substantial amounts of background development occur, the two pairs of strips provide substantially the same amount of toner to waste hopper 44. Therefore, printing using standard size envelopes will result in approximately twice the amount of toner deposited into waste hopper 44 as will printing with media having a width such that its outer edge is located near second width sensor 102. Accordingly, the count originating from media that is not detected by first width sensor 100 will have twice the weighting of the count originating from media that is detected by first width sensor 100 and not detected by second width sensor 102. After the completion of each print job, controller 60 will add the counts of the first and second counters according to the weighting factor and compare this to the predetermined value. If the added and weighted counts are equal to or greater than the predetermined value, then controller 60 will signal formatter 58, which in turn will inform the user that the end of life of electrophotographic print cartridge 10 has been reached.

A specific implementation using two sensors has been disclosed. It will be recognized by one of ordinary skill in the art that these principles can be extended to more than two sensors. Extending this idea to the use of more than two sensors would involve using more than two counters. Furthermore, the count values from the multiple counters would be added using weighting factors that take into account the relative surface areas of photoconductor drum 14 corresponding to each of the sensors. Using more than two sensors provides the advantage of measuring the wear of photoconductor drum 14 with greater accuracy than could be done with two or fewer sensors. By using more than two sensors, information is available to controller 60 that allows it to determine the width of print media 30 with greater accuracy.

Figure 4:
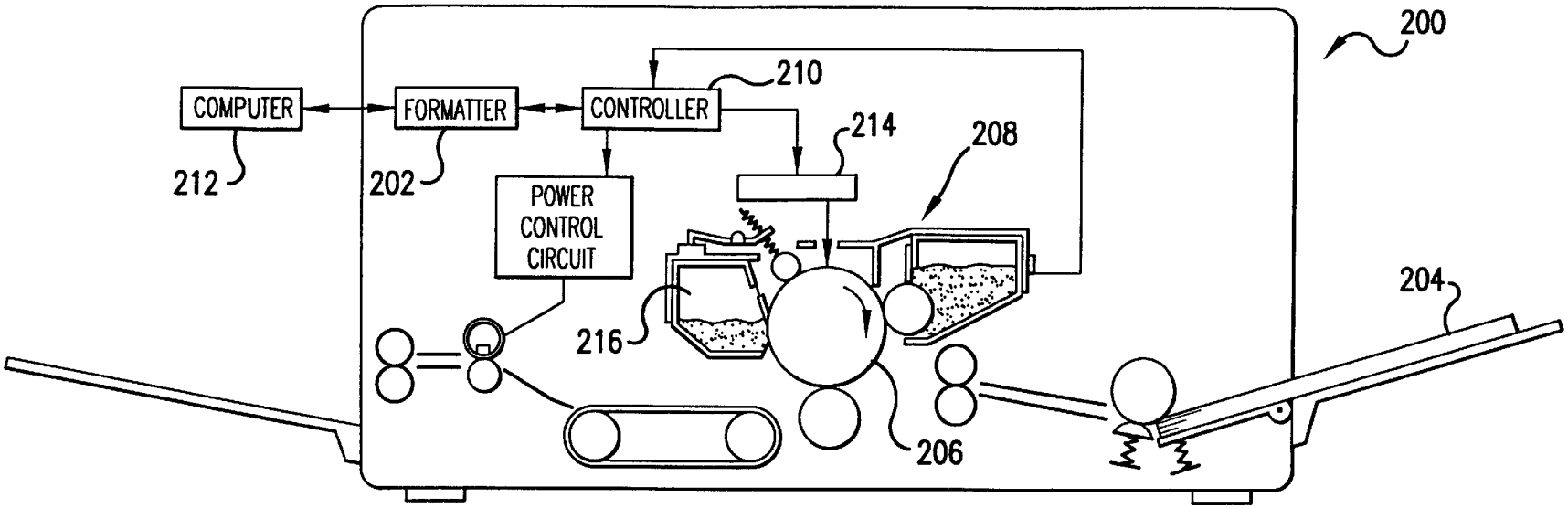
FIG. 4 shows a simplified view of an electrophotographic printer including an embodiment of a system for detecting wear on a photoconductor that does not require a sensor to determine media width.

Shown in FIG. 4 is an electrophotographic printer 200 that can determine the wear on a photoconductor. The electrophotographic printer 200 is able to determine the wear on the photoconductor without the use of a sensor to detect media width. In this implementation, the application initiating the print job sends print data to formatter 58 that includes data specifying the width of the media on which printing will be performed. Firmware operating in formatter 202 includes the capability to separate the width data from the print data. Based upon the width data, for each unit of print media 204, formatter 202 computes (or accesses a lookup table including the information) the area of photoconductor drum 206 that will not be contacting print media 204 during printing. This value of this area is added to a cumulative value of area obtained from data sent for printing on previous units of print media 204. When the cumulative value of the area reaches a predetermined value, formatter 202 informs the user that the end of life for electrophotographic print cartridge 208 has been reached.

The disclosed embodiments of the systems to determine wear on a photoconductor can make use of an empirically determined threshold for the predetermined value. This value would be obtained by testing a population of electrophotographic imaging devices and photoconductors. The population would be of sufficient size and testing would be performed with a sufficiently large variety of media widths (e.g. the narrowest of the narrow media used and various types of media having widths in between the narrowest of the narrow media used and letter sized paper) to determine with high statistical confidence the lower limit of accumulated usage that a photoconductor of that design can tolerate within that electrophotographic imaging device. A safety margin would be added to the measured lower limit of accumulated usage and this value would be used as the empirically derived threshold value.

The system to determine the wear embodied in FIG. 4 has several advantages over the other disclosed embodiments. The embodiment of FIG. 4 does not require sensors to detect the width of print media 204, thereby allowing for less complexity in the hardware implementation. Furthermore, the embodiment of FIG. 4 more accurately determines the wear out of photoconductor drum 206 because a highly accurate value of the media width (as opposed to a relatively broad estimate of the width obtained by using sensors) is provided by the application initiating the print job. To ensure that the cumulative value of the area is not mistakenly incremented (for example, from a print job that is started but not completed), controller 210 would provide confirmation that the print job was completed before the firmware operating in formatter 202 increments the cumulative value of the area. However, this feature is not essential to this embodiment of the system to determine wear on a photoconductor.

Measurements of the accumulated usage (either by counting the units of media of varying widths or by tracking the cumulative value of the area) of a photoconductor by the electrophotographic imaging device are tied to that particular photoconductor. If the photoconductor is replaced with a new photoconductor, measurement of the accumulated usage would be restarted from zero. If the original photoconductor is re-inserted, the accumulated usage measurement for that photoconductor would be used for tracking accumulated usage during subsequent printing.

Accounting for photoconductor changes before reaching end of life can be accomplished in several ways. As, previously discussed, the photoconductor (or the electrophotographic print cartridge of which it is part) could include an identification device, such as a memory for storing information to uniquely identify the photoconductor or electrophotographic print cartridge. Alternatively, the electrophotographic imaging device could query the user upon removal or reinstallation of the photoconductor and request information that would be used to associate the count value or the cumulative value of the area with that particular photoconductor.

Figure 5A:
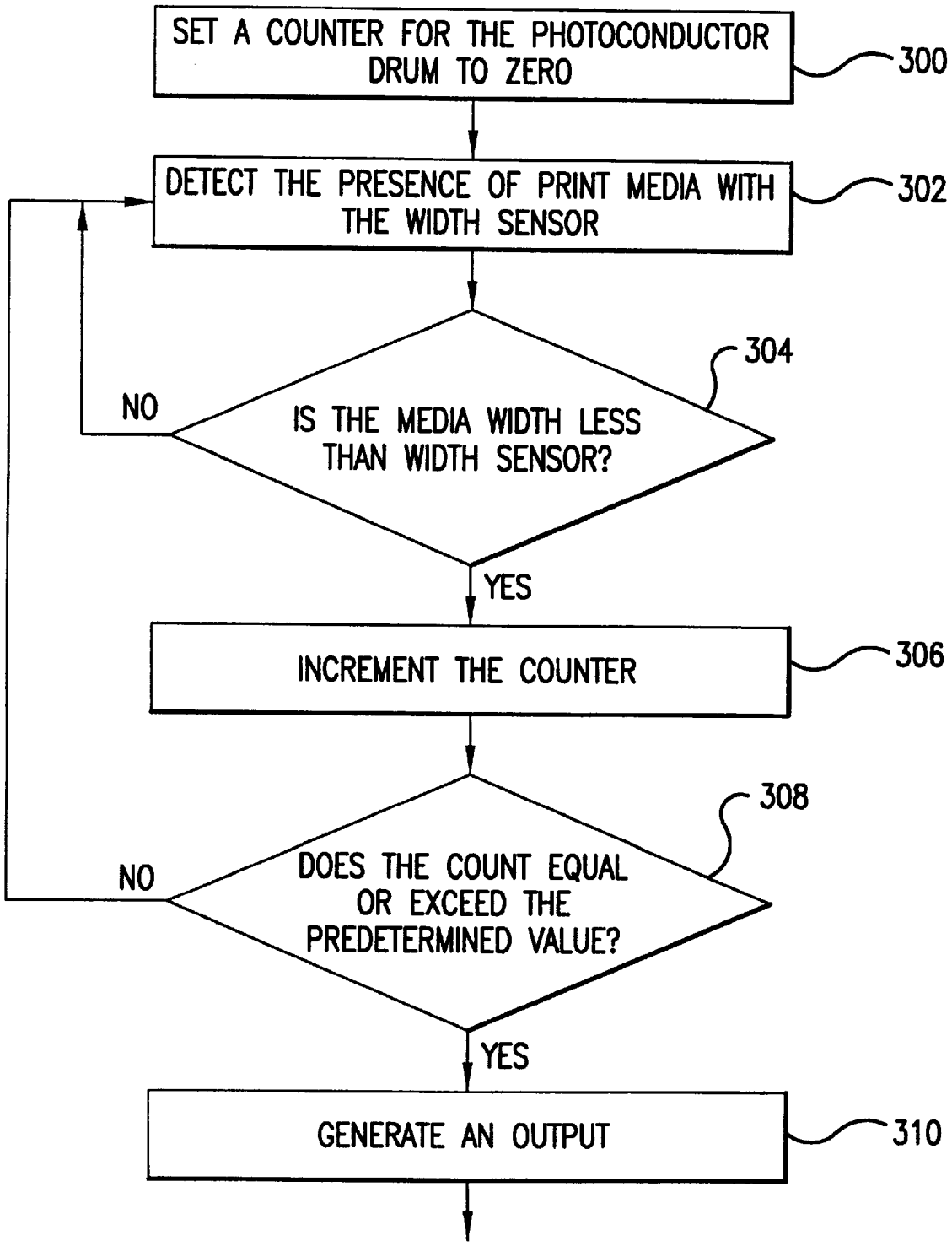
FIGS. 5A and 5B show a high level flow diagram of a first method for detecting wear on a photoconductor.
Figure 5B:
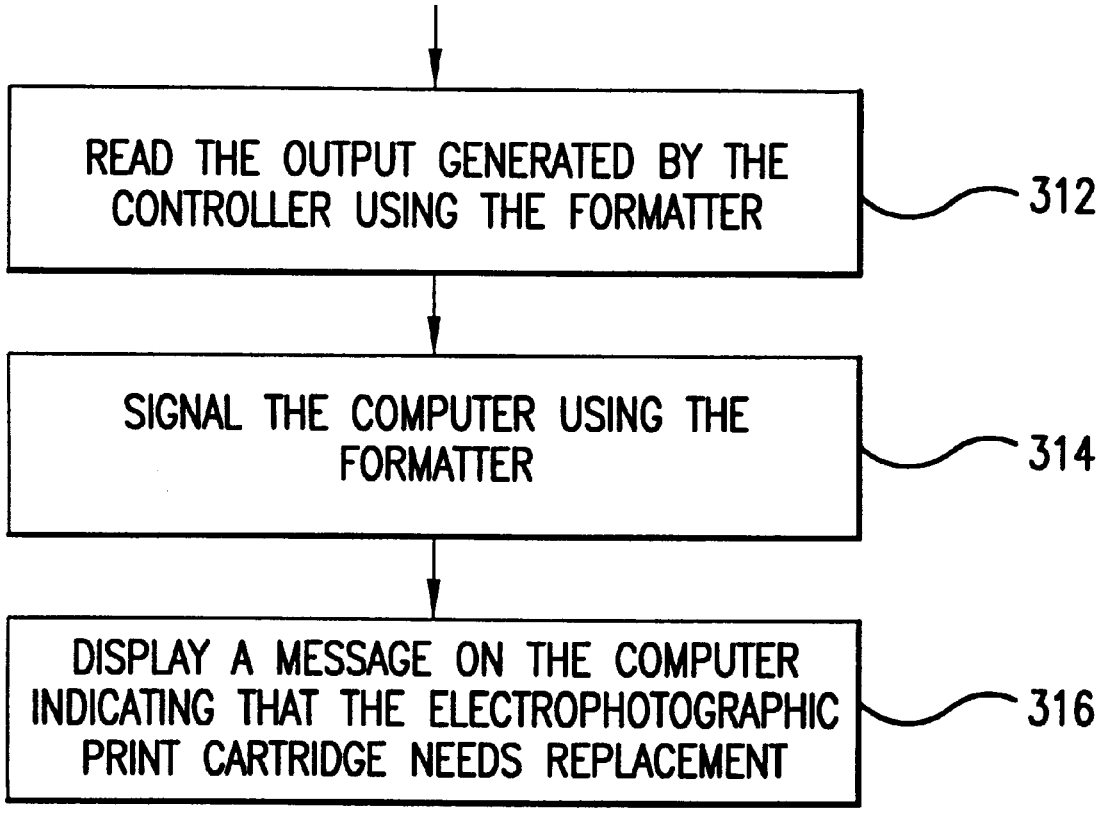

Shown in FIGS. 5A and 5B are a high level flow diagram of a first method for determining wear of a photoconductor. In step 300, controller 60 initializes the counter associated with photoconductor drum 14 to zero. In step 302, width sensor 38 detects whether print media 30 having a width greater than or equal to the width corresponding to the location of width sensor 38 (with respect to the longitudinal axis of photoconductor drum 14) is moving through electrophotographic printer 10. In step 304, controller 60 determines, based upon the output of width sensor 38, whether print media 30 has a width greater than or equal to the width corresponding to the location of width sensor 38. If controller 60 determines the width is greater than or equal to the width corresponding to the location of width sensor 38, then controller 60 repeats step 302. If controller 60 determines the width is less than the width corresponding to the location of width sensor 38, then, in step 306, controller 60 increments the counter implemented in the firmware of controller 60 that counts the number of units of print media 30 used in electrophotographic printer 10 having width less than the width corresponding to the location of width sensor 38. Next, in step 308, controller 60 determines if the value of the counter has exceeded a predetermined limit. This predetermined limit may be empirically derived or derived based upon models of the wear of photoconductor drum 14. If controller 60 determines the value of the counter has not exceeded the predetermined limit, then controller 60 repeats step 302. If the value of the counter has been equaled or exceeded, in step 310 controller 60 generates an output to indicate that the predetermined limit has been equaled or exceeded. Equaling or exceeding the predetermined limit indicates that photoconductor drum 14 has likely experienced wear sufficient so that substantial levels of background development have occurred. Furthermore, equaling or exceeding the predetermined limit indicates that waste hopper 44 is at or near its toner holding capacity.

In step 312, formatter 58 reads the output generated by controller 60. Then, in step 314, formatter 58 signals computer 62 that the predetermined limit has been equaled or exceeded. Finally, in step 316, computer 62 displays a message to the user indicating that electrophotographic print cartridge 28 requires replacement. Alternatively, the message could have been displayed on electrophotographic printer 10. In yet another alternative, the message could be displayed on electrophotographic printer 10 and operation of electrophotographic printer 10 could have been disabled by controller 60 until replacement of electrophotographic print cartridge 28.

Figure 6:
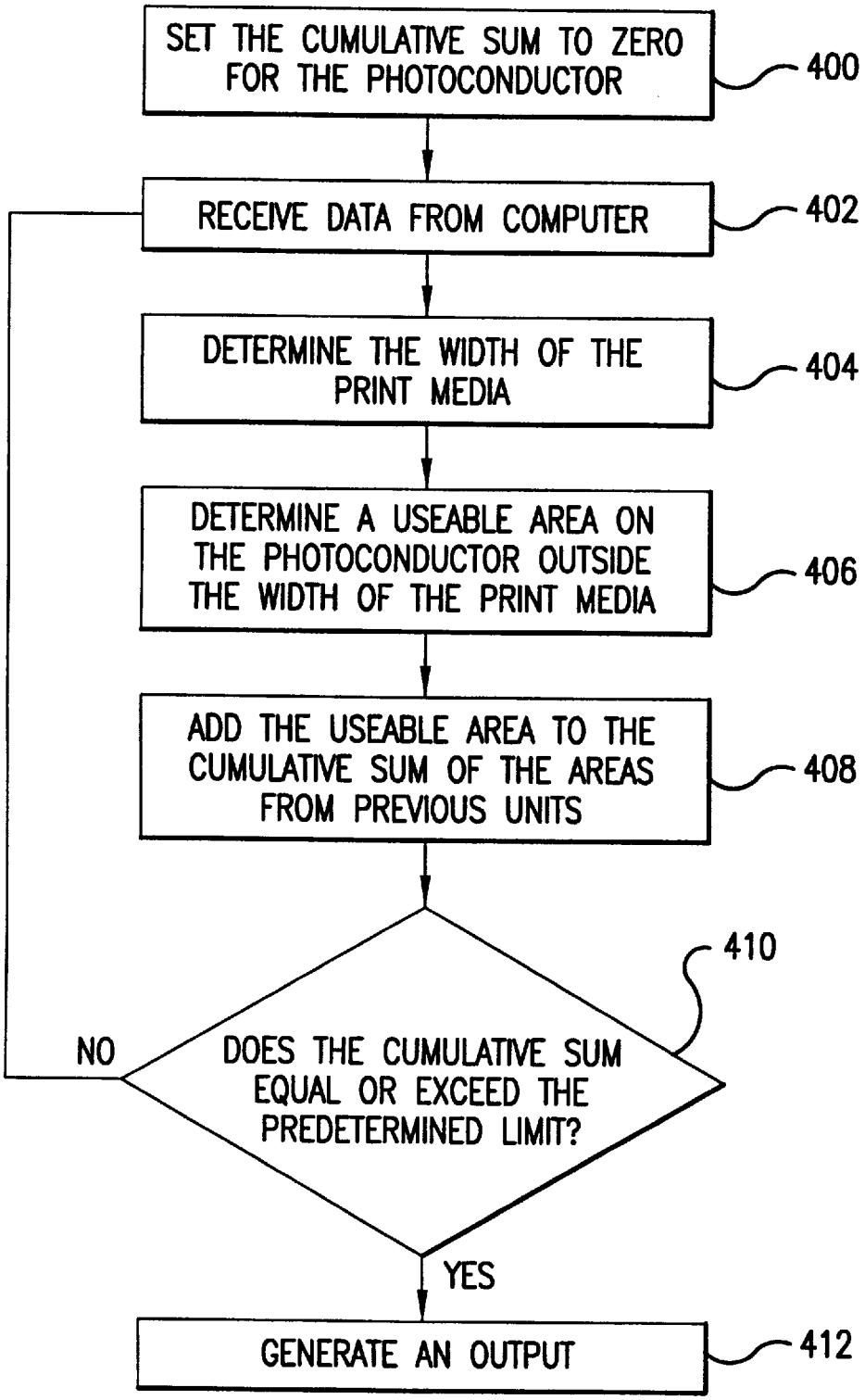
FIG. 6 shows a high level flow diagram of a second method for detecting wear on a photoconductor.

Shown in FIG. 6 is a high level flow diagram of a second method for determining wear of a photoconductor. In step 400, a cumulative sum of the areas of photoconductor drum 206 is set to zero. In step 402, formatter 202 receives data from computer 212. Included in the data is print data and data specifying a width of the print media 204 upon which printing will be formed. In step 404, formatter 202 determines the width of the print media 204 upon which printing will be performed. In step 406, formatter 202 determines an area on a useable portion (useable meaning the area on photoconductor drum 206 on which it is possible for laser scanner 214 to form a latent electrostatic image) of photoconductor drum 206 that lies outside of the width of the print media 204 upon which printing will be performed. This determination may be done by computation or by using a lookup table. In step 408, formatter 202 adds this area to a cumulative sum of the areas of photoconductor drum 206 corresponding to printing on previous units of print media 204. Next, in step 410, formatter 202 determines if the cumulative sum of the areas exceeds a predetermined limit. This predetermined limit can be empirically determined or estimated based upon models of photoconductor wear. If the cumulative sum of the area does not exceed the predetermined limit, then formatter 202 repeats step 402. If the cumulative sum of the area equals or exceeds the predetermined limit, then, in step 412, formatter 202 generates an output to indicate that the predetermined limit has been equaled or exceeded. Equaling or exceeding the predetermined limit indicates that photoconductor drum 206 has likely experienced wear sufficient so that substantial levels of background development have occurred. Furthermore, equaling or exceeding the predetermined limit indicates that waste hopper 216 is at or near its toner holding capacity. Finally, in step 414, computer 212, in response to the output generated by formatter 202 displays a message indicating that electrophotographic print cartridge 208 requires replacement. Alternatively, the message could be displayed on electrophotographic printer 200. In yet another alternative, the message could be displayed on electrophotographic printer 200 and formatter 202 could disable operation of electrophotographic printer 200.

Although several embodiments of the invention have been illustrated, and their forms described, it is readily apparent to those of ordinary skill in the art that various modifications may be made to these embodiments without departing from the spirit of the invention or from the scope of the appended claims.

What is claimed is:

1. In an electrophotographic imaging device, a method for determining wear on a photoconductor, comprising:

determining a plurality of values of a parameter related to a width of media used in the electrophotographic imaging device;

combining the plurality of values of the parameter to generate a first value; and generating an output if the first value equals or exceeds a first predetermined value.

2. The method as recited in claim 1, further comprising:

displaying an indication on the electrophotographic imaging device responsive to the output for prompting corrective action.

3. The method as recited in claim 1, further comprising:

displaying an indication on a computer coupled to the electrophotographic imaging device responsive to the output for prompting corrective action.

4. The method as recited in claim 3, wherein:

the parameter includes the width of the media;

determining the plurality of values includes determining a plurality of ranges of the widths of a plurality of the media using at least one sensor; and generating the output includes comparing the first value to the first predetermined value.

5. The method as recited in claim 4, wherein:

combining the plurality of values includes selectively incrementing at least one counter corresponding to a one of the plurality of ranges of the widths base upon determining the plurality of the ranges of the widths;

weighting a value of at least one counter by a predetermined weighting factor to generate at least one weighted counter value;

and summing the weighted counter value with at leas to one other counter value to generate the first value.

6. The method as recited in claim 5, further comprising:

reading information relating to identification of the photoconductor before determining the plurality of values of the parameter.

7. The method as recited in claim 3, wherein:

the parameter includes the width of the media; and determining the plurality of values includes receiving data from the computer allowing determination of a plurality of the widths corresponding to a plurality of the media; and determining the plurality of values includes determining a plurality of areas corresponding to the plurality of widths, with each of the plurality of areas substantially equal to a difference between a useable area on the photoconductor and a contact area between a corresponding one of the plurality of the media and the photoconductor.

8. The method as recited in claim 7, wherein:

combining the plurality of values includes adding the plurality of areas to generate the first value.

9. An apparatus for determining wear on a photoconductor in an electrophotographic imaging device, comprising:

a first sensor located in the electrophotographic imaging device for detecting a presence of media having a width equal to or greater than a first value; and a processing device coupled to the first sensor to count a first number of units of the media having the width less than the first value, with the processing device configured to generate an output based upon the first number reaching a first predetermined value.

10. The apparatus as recited in claim 9, further comprising:

an identification device configured to provide information to the processing device, with the information related to identification of the photoconductor.

11. The apparatus as recited in claim 10, further comprising:

a second sensor coupled to the processing device and located in the electrophotographic imaging device for detecting a presence of the media having the width equal to or greater than a second value.

12. The apparatus as recited in claim 11, wherein:

the processing device includes a configuration to count a second number of units of the media having the width less than the second value and greater than or equal to the first value, the processing device includes a configuration to weight the first number by a second predetermined value and add the first number to the second number to generate a sum, and the processing device includes a configuration to generate the output based upon the sum reaching a third predetermined value.

13. The apparatus as recited in claim 12, wherein:

the electrophotographic imaging device includes an electrophotographic printer;

the first value substantially equals the width of an envelope; and the second value ranges from less than the width of letter size paper to greater than the width of the envelope.

14. An electrophotographic imaging device to form images on media with toner, comprising:

a photoconductor;

a photoconductor exposure system to generate a latent electrostatic image on the photoconductor;

a developing device to develop the toner onto the latent electrostatic image;

a transfer device to transfer the toner from the photoconductor onto the media;

a fixing device for fixing the toner to the media;

a first sensor for detecting the media having a width equal to or greater than a first value; and a processing device coupled to the first sensor, with the processing device configured to count a first number of the media having a width less than the first value and configured to determine when the first number equals or exceeds a second value.

15. The electrophotographic imaging device as recited in claim 14, further comprising:

a second sensor coupled to the controller and located in the electrophotographic imaging device for detecting a presence of the media having the width equal to or greater than a third value, with the second sensor coupled to the processing device and with the processing device configured to count a second number of the media having a width greater than or equal to the first value and less than the third value.

16. The electrophotographic imaging device as recited in claim 15, wherein:

the photoconductor includes an identification device for supplying information to the controller identifying the photoconductor;

the processing device includes a configuration to add the second number to the first number weighted by a fourth value to generate a sum, a configuration to generate the output based upon the sum reaching a fifth value and a configuration for receiving the information from the identification device.

17. An electrophotographic imaging device to form images on media with toner using data received from a computer, comprising:

a photoconductor;

a photoconductor exposure system to generate a latent electrostatic image on the photoconductor;

a developing device to develop the toner onto the latent electrostatic image;

a transfer device to transfer the toner from the photoconductor onto the media;

a fixing device for fixing the toner to the media; and a processing device configured to receive the data from the computer, with the data including information relating to a width of the media to which the data corresponds, where the processing device includes a configuration to determine an area of the photoconductor substantially equal to a difference between a useable area on the photoconductor and a contact area between the media to which the data corresponds and the processing device includes a configuration to add the area for a plurality of the media.

18. The electrophotographic imaging device as recited in claim 17, wherein:

the processing device includes a formatter.

19. The electrophotographic imaging device as recited in claim 17, wherein:

the processing device includes a controller.

20. The electrophotographic imaging device as recited in claim 19, wherein:

the electrophotographic imaging device includes an electrophotographic printer.

* * * * *

UNITED STATES PATENT AND TRADEMARK OFFICE

CERTIFICATE OF CORRECTION

PATENT NO : 6,108,499

DATED : August 22, 2000

INVENTOR(S) : Cernusak

It is certified that error appears in the above-identified patent and that said Letters Patent are hereby corrected as shown below:

IN THE CLAIMS

Column 16, (line 20), delete "base" and insert therefor--based--.
Column 16, (line 25), delete "leas to" and insert therefor--least--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*